United States Patent [19]

Goodman

[11] Patent Number: 5,061,397

[45] Date of Patent: Oct. 29, 1991

[54] COATED CLAY GRANULES

[75] Inventor: Howard Goodman, St. Austell, England

[73] Assignee: ECC International Limited, Great Britain

[21] Appl. No.: 388,142

[22] Filed: Aug. 1, 1989

[30] Foreign Application Priority Data

Aug. 1, 1988 [GB] United Kingdom ..... 8818277.9

[51] Int. Cl.[5] ..... C11D 3/14; C11D 3/50; C11D 11/00; C11D 17/00

[52] U.S. Cl. ..... 252/174.25; 106/416; 106/437; 106/464; 106/468; 106/DIG. 4; 252/90; 252/174; 252/174.11

[58] Field of Search ..... 252/174.25, 174, 90, 252/174.11; 106/DIG. 4, 416, 437, 464, 468

[56] References Cited

U.S. PATENT DOCUMENTS

| | | | |
|---|---|---|---|
| 3,966,629 | 6/1976 | Dumbrell | 252/140 |
| 4,216,188 | 8/1980 | Shabtai et al. | 423/118 |
| 4,488,972 | 12/1984 | Weinstein | 252/8.6 |
| 4,632,768 | 12/1986 | Atkinson | 252/8.8 |
| 4,671,886 | 6/1987 | Mueller | 252/140 |
| 4,699,729 | 10/1987 | Pam et al. | 252/174.25 |
| 4,885,101 | 12/1989 | Tai | 252/8.6 |

FOREIGN PATENT DOCUMENTS

| | | |
|---|---|---|
| 2241614 | 3/1975 | France . |
| 2524903 | 10/1983 | France . |
| 968055 | 8/1964 | United Kingdom . |
| 981237 | 1/1965 | United Kingdom . |
| 1050148 | 12/1966 | United Kingdom . |
| 1380361 | 1/1975 | United Kingdom . |
| 1437902 | 6/1976 | United Kingdom . |
| 1479238 | 7/1977 | United Kingdom . |
| 2190921 | 12/1987 | United Kingdom . |

*Primary Examiner*—Paul Lieberman
*Assistant Examiner*—A. Beadles-Hay
*Attorney, Agent, or Firm*—Klauber & Jackson

[57] ABSTRACT

There is disclosed a particulate inorganic material, suitable for use in a detergent composition, comprising base granules of a smectite clay coated with a white inorganic material. Also disclosed is a detergent composition comprising a particulate inorganic material and a process for making the particulate inorganic material.

22 Claims, No Drawings

COATED CLAY GRANULES

This invention relates to improved smectite clay granules which are specially adapted for incorporation in detergent compositions, and to a method for preparing such granules.

British Patent specification No. 2121843 describes a particulate fabric softener suitable for incorporation in detergent compositions which consists of agglomerates of fine bentonite powder. The agglomerates described suffer from two disadvantages. Most naturally occurring fine bentonites are relatively dark in colour and the agglomerates, therefore, tend to exhibit an undesirable dark colouration. Also, when it is desired to incorporate a perfume in the detergent composition, this is generally either included in the detergent beads or sprayed over the mixture of detergent beads and smectite clay granules. However, the clay granules, having a very open internal structure, tend to absorb the component of the perfume with a consequent reduction in the intensity and/or quality of the fragrance. The present invention provides smectite clay granules for use in detergent compositions, which granules are whiter in colour and have a reduced tendency to absorb perfume components than conventionally used smectite clay granules.

According to one aspect of the present invention, there is provided a detergent composition comprising base granules of a smectite clay coated with a white inorganic material.

According to a second aspect of the present invention, there is provided a particulate inorganic material, suitable for use in a detergent, comprising base granules of a smectite clay coated with a white inorganic material.

Preferably, the base granules of smectite clay have diameters within the range of from 0.15 mm to 1.5 mm and, preferably, from 1% by weight to 100% by weight, based on the weight of dry base granules, of the white inorganic material is employed The particulate material may also contain a binder, for example a styrene butadiene rubber latex or an acrylic latex or a hydrophilic polymer such as starch, sodium carboxymethyl cellulose or hydroxyethyl cellulose.

The smectite clay may be, for example, bentonite, montmorillonite, hectorite, saponite, beidellite or fullers earth. Preferably, the base granules may be formed by granulating a fine smectite clay, for example one having a particle size distribution such that substantially all of the particles have a diameter smaller than 50 microns. Preferably, the granules in accordance with the invention contain from 2% to 15% by weight of the white inorganic material, based on the . weight of the dry base granules.

The detergent composition preferably contains a water-soluble detergent compound and a detergent builder salt. Preferably, the water-soluble detergent compound will be present in the composition in an amount of at least 5% but no greater than about 20% by weight and the detergent builder salt (which may be organic or inorganic) will be present in an amount of at least 10% but no greater than 60% by weight. The remainder of the detergent composition to 100% by weight consists of bound water and various optional ingredients, such as perfumes and impurities.

The white inorganic material may be, for example, a hydrous or calcined kaolin clay, calcium carbonate, titanium dioxide or the like, and preferably has a particle size distribution such that at least 30% by weight consists of particles having an equivalent spherical diameter smaller than 2 microns.

According to a third aspect of the present invention, there is provided a process for preparing a particulate inorganic material comprising base granules of a smectite clay coated with a white inorganic material comprising the steps of:

(a) mixing a white inorganic material in dry powder form with dry base granules of a smectite clay;
(b) spraying an aqueous medium onto the mixture formed in step (a) whilst agitating the mixture; and
(c) drying the agitated mixture formed in step (b).

According to a fourth aspect or the present invention, there is provided a process for preparing a particulate inorganic material comprising base granules of a smectite clay coated with a white inorganic material comprising the steps of:

(a) spraying an aqueous suspension of a white inorganic material onto base granules of a smectite clay whilst agitating the base granules; and
(b) drying the agitated mixture formed in step (a).

Thus, the white inorganic material may be coated on to the base granules by one of the following two methods:

a) The white inorganic material in dry powder form is mixed with the dry base granules and an aqueous medium is sprayed on to the mixture, preferably in the form of fine droplets, while the mixture is agitated or rotated in, for example, a pan granulator. The amount of the aqueous medium required is generally from about 5% to about 15% of the total weight of base granules and white inorganic material. The aqueous medium may consist of water alone or it may contain a small proportion, for example up to about 25% of the total weight of the aqueous medium, of a dissolved or suspended binder material. The binder material may be, for example, a styrene butadiene rubber latex or an acrylic latex or a hydrophilic polymer such as starch, sodium carboxymethyl cellulose or hydroxyethyl cellulose.

b) The base granules are agitared or rotated in, for example, a pan granulator and as aqueous suspension preferably containing from about 40% by weight to about 75% by weight of the white inorganic material, preferably in the form of fine droplets, is sprayed on to the base granules. The aqueous suspension may also contain from about 0.01% by weight to about 2% by weight, based on the weight of the white inorganic material, of a dispersing agent.

The coated granules prepared be either of methods a) or b) above are then dried using only gentle mechanical agitation to avoid disintegration of the granules.

The coated granules in accordance with the invention are found to be whiter in colour than conventional smectite clay granules prepared for use in detergent compositions and when the coated granules are incorporated in a detergent composition which also contains a perfume the reduction of the intensity and/or quality of the fragrance is appreciably less pronounced than is the case with conventional granules.

The invention will now be illustrated by the following Examples.

EXAMPLE 1

A sample of bentonite having a particle size distribution such that 99% by weight consisted of particles smaller than No. 300 mesh British Standard Sieve (nominal aperture 53 microns) was formed into granules which had a mean diameter of about 1 mm. 600 g of dry bentonite granules were mixed with 60 g of a powdered, hydrous kaolin clay which and a particle size distribution such that 0.2% by weight consisted of particles having an equivalent spherical diameter larger that 10 microns and 80% by weight consisted of particles having an equivalent spherical diameter smaller than 2 microns. The dry mixture was then rotated in the pan of a pan granulator and water was sprayed into the pan in the form of fine droplets from an atomiser until the bentonite granules appeared to be evenly coated with the kaolin clay. At the completion of this operation it was found that a total of 78 g of water had been sprayed on to the clay mixture. The coated granules were then dried in an oven at 60° C. 16 hours and five samples of the dry granules were charged into low-sided cylindrical dishes and lightly pressed down by means of a glass flute to form a nearly level upper surface. The reflectance to light of wavelength 457 nm and 570 nm respectively was then measured for each sample by means of an Elrepho reflection photometer and the mean of the five measurements for each wavelength was recorded.

As a comparison, similar reflectance measurements were performed on samples of the uncoated bentonite granules.

The results obtained are set forth in Table I below:

TABLE I

| | % reflectance to light of wavelength | |
|---|---|---|
| | 457 nm | 570 nm |
| Uncoated granules | 55.7 | 62.1 |
| Coated granules | 60.1 | 65.8 |

A detergent composition incorporating the granules was prepared according to the following formulation:

| Ingredient | % by weight |
|---|---|
| Alkyl benzene sulphonate | 6.4 |
| Soap | 2.8 |
| Inorganic builder salt | 15.0 |
| Fatty alcohol ethoxylate | 2.3 |
| Granules | 10.0 |
| Other components, including perfume, and bound water to | 100.0 |

It was found that the deleterious effect on the fragrance or perfume was less with the coated granules than with the uncoated granules.

EXAMPLE 2

The same dry powdered bentonite as was used in Example 1 was formed into granules having a mean diameter of 0.25 mm and two samples of the dry granules were mixed, respectively, with 2% by weight, based on the weight of dry granules, of fine titanium dioxide powder, and with 5% by weight, based on the weight of dry granules, of a calcined kaolin clay having a particle size distribution such that 8% by weight consisted of particles having an equivalent spherical diameter larger than 10 microns and 50% by weight consisted of particles having an equivalent spherical diameter smaller than 2 microns.

Each dry clay mixture was rotated in the pan of a pan palletiser and water was sprayed on to the mixture in the form of fine droplets from an atomiser, the total amount of water added in each case being 10% by weight, based on the weight of the dry mixture.

The two batches of coated bentonite granules and a sample of the uncoated granules were subjected to particle size separation by sieving to yield a fraction consisting of granules in the size range from 0.42 mm to 0.85 mm (No.36 to No.18 mesh British Standard Sieve) and five samples were taken from this fraction for each batch and tested for reflectance to light of wavelength 457 nm and 570 nm as described in Example 1.

The results obtained are set forth in Table II below:

TABLE II

| | % reflectance to light of wavelength | |
|---|---|---|
| | 457 nm | 570 nm |
| Uncoated granules | 52.6 | 59.5 |
| Granules coated with 2% by wt. titanium dioxide | 58.7 | 63.1 |
| Granules coated with 5% by wt. calcined kaolin | 59.8 | 64.5 |

A sample of each batch of bentonite granules was also mixed with water using a high speed mixer to form a suspension containing 5% by weight of dry solids and the reflectance to light of wavelength 457 nm and 570 nm was determined for each suspension.

The results obtained are set forth in table III below:

TABLE III

| | % reflectance to light of wavelength | |
|---|---|---|
| | 457 nm | 570 nm |
| Uncoated granules | 34.0 | 37.0 |
| Granules coated with 2% by wt. titanium dioxide | 38.1 | 41.8 |
| Granules coated with 5% by wt. calcined kaolin | 54.4 | 59.9 |

A detergent composition was made up using the formulation given in Example 2 and , again it was found that the deleterious effect on the fragrance was less in the case of the coated granules than with the uncoated granules.

I claim:

1. In a detergent composition comprising a perfume and granules of a smectite clay, the improvement which comprises coating the granules of smectite clay with from about 1-100% by weight of the dry clay granules of a white inorganic material.

2. A detergent composition according to claim 1 wherein said white inorganic material is selected form the group consisting of hydrous kaolin clay, a calcined kaolin clay, calcium carbonate and titanium dioxide.

3. A detergent composition according to claim 1, wherein the base granules of clay have diameters of at least 0.15 mm.

4. A detergent composition according to claim 1, wherein the base granules of clay have diameters no greater than 1.5 mm.

5. A detergent composition according to claim 1, wherein the base granules are coated with from 2% to 15% by weight of the white inorganic material, based on the weight of dry base granules.

6. A detergent composition according to claim 1, wherein the white inorganic material has a particle size distribution such that at least 30% by weight consists of particles having an equivalent spherical diameter smaller than 2 microns.

7. A detergent composition according to claim 1, wherein the white inorganic material is bound to the smectite clay granules with a binder, said binder being employed in an amount of up to about 5% by weight of the total weight of the base granules and white inorganic materials.

8. A particulate inorganic material, suitable for use in a detergent composition, comprising base granules of a smectite clay coated with a white inorganic material, wherein the base granules are coated with from 1 to 100% by weight of the white inorganic material, based on the weight of dry base granules.

9. A particulate inorganic material according to claim 8, wherein the base granules are coated with from 2% to 15% by weight of the white inorganic material, based on the weight of dry base granules.

10. A particulate inorganic material according to claim 8, wherein the white inorganic material has a particle size distribution such that at least 30% by weight consists of particles having an equivalent spherical diameter smaller than 2 microns.

11. A particulate inorganic material according to claim 8, wherein a binder is employed in an amount of up to about 5% by weight of the total weight of base granules and white inorganic material.

12. A particulate inorganic material, suitable for use in a detergent composition, comprising base granules of a smectite clay coated with a white inorganic material, wherein the base granules are coated with from 1 to 100% by weight of the white inorganic material, based on the weight of dry base granules; and wherein the white inorganic material is selected from the group consisting of a hydrous kaolin clay, a calcined kaolin clay, calcium carbonate and titanium dioxide.

13. A particulate inorganic material according to claim 12, wherein the base granules have diameters of at least 0.15 mm.

14. A particulate inorganic material according to claim 8 or 13, wherein the base granules of clay have diameters no greater than 1.5 mm.

15. A particulate inorganic material, suitable for use in a detergent composition, comprising base granules of a smectite clay having diameters of at least 0.15 mm, and being coated with a white inorganic material.

16. A process for preparing a particulate inorganic material comprising base granules of a smectite clay coated with a white inorganic material comprising the steps of:

(a) mixing a white inorganic material in dry powder form with dry base granules of a smectite clay;

(b) spraying an aqueous medium onto the mixture formed in step (a) whilst agitating the mixture; and (c) drying the agitated mixture formed in step (b).

17. A process according to claim 16, wherein the amount of aqueous medium employed is from 5% to 15% by weight based on the total weight of the base granules and white inorganic material.

18. A process according to claim 16, wherein the aqueous medium is water alone.

19. A process according to claim 16, wherein the aqueous medium contains a dissolved or suspended binder material in an amount of up to about 25% by weight of the aqueous medium.

20. A process for preparing a particulate inorganic material comprising base granules of a smectite clay coated with a white inorganic material comprising the steps of:

(a) spraying an aqueous suspension of a white inorganic material onto base granules of a smectite clay whilst agitating the base granules; and (b) drying the mixture formed in step (a).

21. A process according to claim 20, wherein the aqueous suspension comprises from 40% to 75% by weight of the white inorganic material.

22. A process according to claim 20, wherein the aqueous suspension further contains from 0.01% to 2% by weight, based on the weight of the white inorganic material, of a dispersing agent.

* * * * *